United States Patent [19]

Kinouchi et al.

[11] Patent Number: 4,831,954

[45] Date of Patent: May 23, 1989

[54] FIN TAB DEVICE FOR MARINE VESSELS

[75] Inventors: Sosuke Kinouchi, Kakogawa; Hideto Yoshitake, Akashi, both of Japan

[73] Assignee: Kawasaki Jukogyo Kabushiki Kaisha, Hyogo, Japan

[21] Appl. No.: 117,698

[22] Filed: Nov. 6, 1987

[30] Foreign Application Priority Data

Nov. 10, 1986 [JP] Japan ..... 173175[U]

[51] Int. Cl.[4] ..... B63H 5/10

[52] U.S. Cl. ..... 114/163; 114/152

[58] Field of Search ..... 114/152, 144 R, 163, 114/162, 128, 127, 39.1; 440/3

[56] References Cited

U.S. PATENT DOCUMENTS

| | | | |
|---|---|---|---|
| 2,710,587 | 6/1955 | Kutchar | 114/163 |
| 2,956,533 | 10/1960 | De Yo | 114/152 |
| 3,080,845 | 3/1963 | Pollak | 114/163 |
| 3,407,774 | 10/1968 | Burke | 114/163 |
| 3,580,208 | 5/1971 | Hinckley | 114/163 |
| 3,606,852 | 9/1971 | Cafiero | 114/163 |
| 4,284,025 | 8/1981 | Eckharp | 114/163 |
| 4,458,622 | 7/1984 | Anderson | 114/39.1 |
| 4,468,606 | 8/1984 | Quintal | 114/39.1 |
| 4,582,011 | 4/1986 | Logan | 114/39.1 |

FOREIGN PATENT DOCUMENTS

| | | | |
|---|---|---|---|
| 59-70292 | 4/1984 | Japan | 114/285 |
| 103373 | 1/1917 | United Kingdom | 114/163 |

*Primary Examiner*—Sherman D. Basinger
*Assistant Examiner*—Clifford T. Bartz
*Attorney, Agent, or Firm*—Wenderoth, Lind & Ponack

[57] ABSTRACT

A fin tab device for a marine vessel driven by a propeller is provided with a fin-shaped main fin tab member and a fin-shaped sub-fin tab member, both tab members extending downwardly from a substantially planar fixing portion detachably and adjustably secured to the bottom face of a stern structure. The two tab members are in an in-line, spaced-apart, tandem relation, the sub-fin tab member projecting downwardly a shorter distance than the main fin tab member. The sub-fin tab member is at a positon between the tip circle of the propeller and the main fin tab member. Cavitation bubbles first collide with the sub-fin tab member, imparting impact force thereto, whereby the lower end portion thereof is broken while the main fin tab member is shielded and protected by the sub-fin tab member.

9 Claims, 1 Drawing Sheet

FIN TAB DEVICE FOR MARINE VESSELS

BACKGROUND OF THE INVENTION

This invention relates to a fin tab device for making compensative adjustment for straightaway or straight-line movement of vessels, and more specifically to a trim tab device of this character which functions also as an anode for marine vessels.

In general, in an outboard engine, an inboard engine unit with outboard drive unit, etc. of, for example, 30 horsepower or more, a fin tab is provided in the slip-stream or race produced by a propeller of a vessel (see Japanese Patent Appln. Laid-Open Publication No. 59-70292. The fin tab is acted upon by the flow of water produced by the rotation of the propeller to prevent the production of a steering biasing force on the vessel when the helmsman intends to propel the vessel in a straight-line course, thereby facilitating the steering of the vessel. Furthermore, the fin tab is made of, for example, zinc (Zn) alloy and serves as an anode. That is, galvanic or electrolytic corrosion is caused to concentrate on the fin tab to thereby protect other components of the vessel and the outboard engine from being corroded.

The rotation of a propeller produces cavitation behind the outer tips of the propeller blades. The bubbles of the cavitation strike the fin tab and collpase, imparting impact forces to the fin tab. But the fin tab, which functions as an anode as well and is made of a material of weak mechanical strength such as zinc (Zn) alloy or the like, is subjected not only to the erosive wear due to corrosion but also to the forces due to the cavitation, and the lower portion of the fin tab is severly attrited. As a consequence, the fin tab ordinarily is replaced with a new one every year or every two years. That is, the service life of the fin tab is short.

In view of the above described problems of the prior art fin tab the object of this invention is to provide a fin tab device for marine vessels which has a long service life.

SUMMARY OF THE INVENTION

In order to attain the foregoing object, the device according to this invention comprises a main fin tab member and a sub-fin tab member, the main and the sub-fin tab members being formed in one piece with a fixing portion constituting a portion of a cavitation plate. The main fin tab member is projected downwardly from the fixing portion at a downstream region of the flow produced by the propeller. The sub-fin tab member has a smaller area and has a smaller portion projected from the fixing portion than the main fin tab member and is positioned between the propeller and the main fin tab member and spaced apart from the main trim tab.

According to this invention, some of the bubbles of cavitation collide with the sub-fin tab member disposed between the propeller and the main fin tab member and collapse, while other bubbles collapse as a consequence of the high-pressure surrounding water in the vicinity of the sub-fin tab member, imparting impact force to the sub-fin tab member. Consequently, the sub-fin tab member is attrited at its lower end portion but in turn shields the main fin tab member. However, the sub-fin tab member is from the beginning projected by such a small area so that there is no risk of a large lower end portion being broken off, and only a small end portion is attrited. Even when the lower end portion of the sub-fin tab member is attrited or broken, the breakage is minor with respect to the whole fin tab device without substantial degradation of its functional capacity.

DETAILED DESCRIPTION OF PREFERRED EMBODIMENT

One embodiment of this invention will now be described with reference to the drawings.

Figure 1:
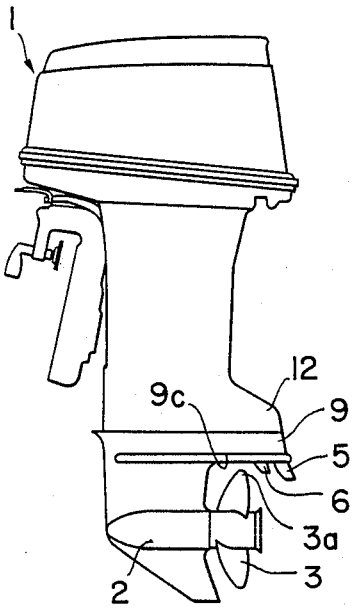
FIG. 1 is a port side view of an outboard engine using the fin tab device according to this invention.
Figure 2:
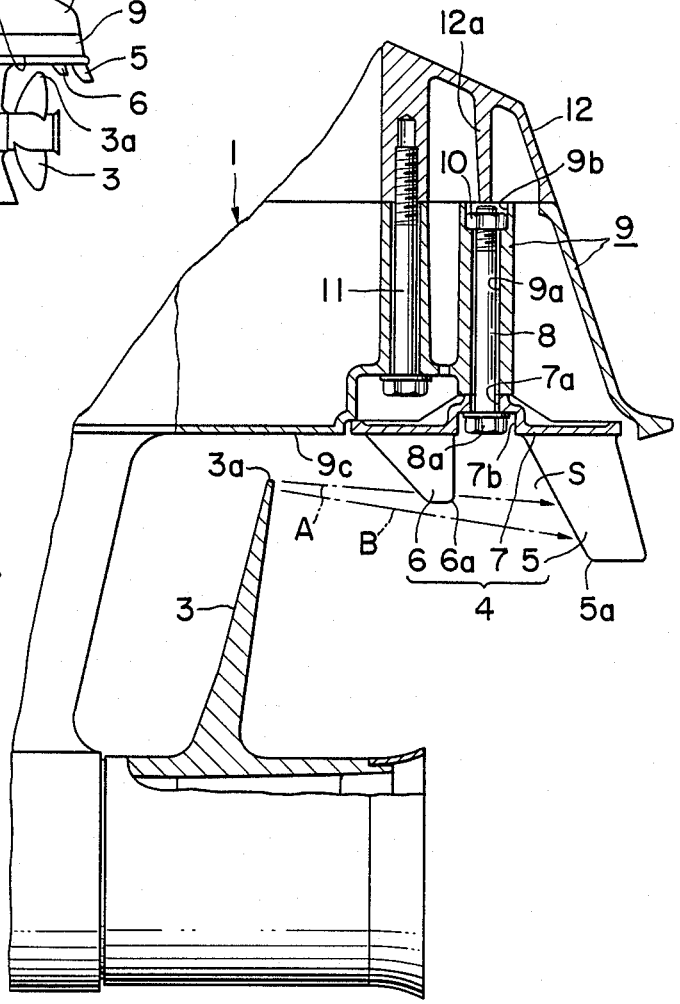
FIG. 2 is a fragmentary enlarged side view, in vertical section, of a part of the outboard engine shown in FIG. 2.

In FIG. 1 reference numeral 1 generally indicates an outboard engine having a drive unit 2, a propeller 3, and a cavitation plate 9*c*. As shown in FIG. 2, a fin tab device 4 is disposed aft of the tip 3*a* of the propeller blade 3.

The fin tab device 4 comprises essentially a fin-shaped main fin tab or fin tab member 5, a sub-fin tab or sub-fin tab member 6, and a fixing portion 7 constituting a part of the cavitation plate 9*c*. The fin tabs 5 and 6, and the fixing portion 7 are cast integrally in one piece which is made of a material such as Zn alloy or the like and functions as an anode of the vessel on which the outboard engine 1 is mounted. The main fin tab 5 projects a relatively great distance downward from the fixing portion 7 into the vortex flow produced by the propeller 3. The sub-fin tab 6 is spaced apart from the main fin tab 5 by a space S and is disposed between the propeller 3 and the main fin tab 5. The sub-fin tab 6 has a smaller area and is projected from the fixing portion 7 by a smaller distance than the main fin tab 5. In this embodiment, the sub-trim tab 6 is so positioned that its tip 6*a* is above a line interconnecting the tip 3*a* of the propeller blade 3 and the tip 5a of the main fin tab 5.

The fixing portion 7 is disk-shaped and has in the center thereof a through hole 7*a* for a mounting bolt 8 to be passed upwardly therethrough. At the center of the underside of the fixing portion 7 is formed a recess 7*b* for receiving therein the head 8*a* of the bolt 8. Both the main fin tab 5 and the sub-fin tab 6 are oriented radially of the disk-shaped fixing portion 7 and lie in the same plane. Their directions are selectively set by loosening the mounting bolt 8 to adjust the trim steering force.

A lower housing 9 has a through hole 9a for receiving therethrough the shank of the mounting bolt 8. A hexagonal recess 9*b* formed at the top of the through hole 9*a* receives a hexagonal nut 10 and prevents the rotation thereof. The bolt 8 and the nut 10 fix the fixing portion 7 against the lower housing 9. The fixing portion 7 is so mounted that the underside of the fixing portion does not protrude out of the lower housing 9. The cavitation plate 9*c* is formed integrally in one piece with the lower housing 9. An upper housing 12 is also fixed to the lower housing 9 by a bolt 11. The upper housing 12 has a rib 12*a* at a position thereof confronting the nut 10 so as to prevent the hexagonal nut 10 from being displaced upwardly when the mounting bolt 8 is screwed into the nut 10.

With this structural arrangement, any bubbles due to cavitation flow in the direction of a arrow A shown in FIG. 2 to strike against the portion of the sub-fin tab 6 near the tip thereof and collapse, thus imparting an impact force to the sub-fin tab 6. Consequently, the sub-trim tab 6 is not only attrited by corrosion but also is eroded by this impact force until, eventually, the sub-fin tab 6 is chipped off in a small region near its lower tip 6*a*. On the other hand, most of the bubbles are caused to collapse by the sub-fin tab 6, and the bubbles surviving contact with the sub-fin tab 6 mostly collapse while they are pasing the space S aft of the sub-fin tab 6 before they reach the main fin tab 5. Accordingly, the main trim tab is not readily damaged. Since the lower portion of the small sub-fin tab 6 is attrited by only a small amount, such damage does not greatly impair the function of the fin tab device 4 as a whole. With the sub-trim tab 6 thus attrited, the fin tab device 4 can be used by adjusting the directions of both the main and the sub-fin tabs. When the sub-trim tab 6 is thus damaged, the bubbles clear the sub-fin tab 6 but collapse under the high-pressure surrounding atmosphere in the neighborhood of the sub-fin tab 6, whereby the main trim tab 5 is protected. Therefore, the fin tab device 4 can be used over a long period of service.

Generally, the size of the propeller 3 is selected in accordance with the size and type of the vessel on which the outboard engine 1 is to be mounted. Consequently, the position at which the vortex is generated varies. But according to this invention, even when the bubbles flow in the direction of an arrow B shown in FIG. 2 to clear the lower tip 6*a* of the sub-fin tab 6, the high-pressure surrounding atmosphere causes the bubbles to collapse as described above, whereby the main fin tab 5 is protected. Therefore the same fin tab device 4 according to this invention can be used commonly with various types of propellers to attain the above described advantageous effects.

Furthermore, since two fin tabs 5 and 6 are provided in a fore-and-aft tandem arrangement their total area can be made less than that of a single large fin tab, that is, as in the prior art. Besides, the two fin tabs 5 and 6 are formed unitarily in one piece, and it is not necessary to adjust their orientation individually and separately. Therefore the fin tabs 5 and 6 can be adjusted as easily as the prior art fin tab, and their productivity is thereby not lowered.

As described above, since the fin tab device according to this invention has a main fin tab and a sub-trim tab, the serviceable life of the fin tab device can be elongated, and the fin tab device can be used in conjunction with various types of propellers. Furthermore, the total area of the fin tabs according to this invention is smaller than that of a fin tab device of the prior art. In addition, the fin tab device of this invention can be manufactured and adjusted as easily as those in the prior art.

What is claimed is:

1. A fin tab device for a marine vessel which is driven by a propeller and has a stern structure disposed above and spaced apart from the propeller, said fin tab device comprising, in an integral combination, a fixing portion secured to a bottom face of said stern structure, a fin-shaped main fin tab member fixed at an upper root part thereof perpendicularly to an aft part of said fixing portion and projecting downwardly into the slipstream region of the propeller, a fin-shaped sub-fin tab member fixed at an upper part thereof perpendicularly to a fore part of said fixing portion at a position between the propeller and said main fin tab member and with a spaced-apart, tandem relation to said main fin tab member and projecting downwardly a shorter distance than said main fin tab member, the planar area of said main fin tab member being greater than that of said sub-fin tab member, a single bolt passing upwardly through a hole in the center of said fixing portion and screw-engaged with female threads provided in the stern structure, said fin tab device functioning to make compensative steering adjustment to attain straight-line travel of the vessel under way and further serving as an anode for lessening galvanic corrosion of other underwater parts of the vessel.

2. A fin tab device according to claim 1, wherein said fixing portion is secured to the bottom face of the lower housing of an outboard engine for driving the vessel.

3. A fin tab device according to claim 1, wherein said fixing portion is of substantially planar shape and is substantially flush with the bottom face of the stern structure.

4. A fin tab device according to claim 3, wherein said fixing portion is secured in a manner permitting adjustment of angular orientation thereof about a vertical axis.

5. A fin tab device according to claim 1, wherein said main fin tab member and sub-fin tab member are disposed in in-line relation.

6. A fin tab device according to claim 1, wherein said fixing portion constitutes an aft portion of a cavitation plate forming the bottom face of said stern structure.

7. A fin tab device according to claim 1, wherein the lower end tip of said sub-fin tab member is above an imaginary line interconnecting the highest point of the propeller and the lower end tip of said main fin tab member.

8. A fin tab device for a marine vessel which is driven by a propeller and has a stern structure disposed above and spaced apart from the propeller, said fin tab device comprising, in an integral combination, a fixing portion secured to a bottom face of said stern structure, a main fin tab member fixed at an upper root part thereof perpendicularly to an aft part of said fixing portion and projecting downwardly into the slipstream region of the propeller, sub-fin tab member fixed at an upper root part thereof perpendicularly to a fore part of said fixing portion at a position between the propeller and said main fin tab member and with a spaced-apart, tandem relation to said main fin tab member and projecting downwardly a shorter distance than said main fin tab member, the planar area of said main fin tab member being greater than that of said sub-fin tab member, and a single vertical bolt securing said fixing portion to the bottom face of the stern structure, said single bolt have an upper end screw-engaged with female threads provided in the stern structure, said single bolt having a lower end supporting said fixing portion, said fin tab device functioning to make compensative steering adjustment to attain straight-line travel of the vessel under way and further serving as an anode for lessening galvanic corrosion of other underwater parts of the vessel.

9. A fin tab device according to claim 8, wherein said single bolt is passed at its lower end through a hole formed in the center of said fixing portion.

* * * * *